US006182295B1

(12) United States Patent
Sciglia

(10) Patent No.: US 6,182,295 B1
(45) Date of Patent: Feb. 6, 2001

(54) HAT

(76) Inventor: Kevin Sciglia, 6270 Piedmont, Spring Hill, FL (US) 34606

( * ) Notice: Under 35 U.S.C. 154(b), the term of this patent shall be extended for 0 days.

(21) Appl. No.: 09/332,341

(22) Filed: Jun. 14, 1999

(51) Int. Cl.[7] ..... A42B 1/00
(52) U.S. Cl. ..... 2/200.1; 2/7; 2/175.1
(58) Field of Search ..... 2/7, 8, 175.1, 195.1, 2/200.1, 209.13, 175.3, 171.2, 181, 184.5, 171, 410

(56) References Cited

U.S. PATENT DOCUMENTS 1,405,061 * 1/1922 Mouromtzeff et al. ..... 2/7
2,357,851 * 9/1944 Scheyer ..... 106/193
2,391,959 * 1/1946 Gallowhur ..... 2/78
2,803,827 * 8/1957 Lipschutz ..... 2/195
2,893,014 * 7/1959 Mabry ..... 2/200
3,365,727 * 1/1968 Hoffman ..... 2/192
3,766,565 * 10/1973 Cozzens ..... 2/209.7
5,018,220 * 5/1991 Lane et al. ..... 2/5
5,157,788 * 10/1992 Schultz ..... 2/7
5,271,099 * 12/1993 Lin ..... 2/10
5,323,491 * 6/1994 Barrett, Jr. ..... 2/207
5,570,476 * 11/1996 Olive ..... 2/200.1
5,630,230 * 5/1997 Fujino et al. ..... 2/200.1
5,669,075 * 9/1997 Weeks ..... 2/172
5,832,538 * 11/1998 Williams ..... 2/202

* cited by examiner

*Primary Examiner*—Amy B. Vanatta
(74) *Attorney, Agent, or Firm*—A. W. Fisher, III

(57) ABSTRACT

A hat constructed of woven fabric capable of reflecting radiant energy from the exterior thereof and of releasing thermal energy from the interior thereof, the hat comprising a side band having a top panel and a double ply outer brim attached to the upper and lower peripheral portions thereof to shield the head, neck and face of the wearer from the elements and to allow heat to escape from the interior thereof.

40 Claims, 2 Drawing Sheets

HAT

BACKGROUND OF THE INVENTION

1. Field of the Invention

A hat constructed of woven fabric capable of reflecting radiant energy from the exterior thereof and of releasing thermal energy from the interior thereof.

2. Description of Prior Art

Hats provide shade to protect the user's head from the direct rays of the sun. While the sun's rays to some degree blocked from the wearer's head, radiant energy is absorbed by the hat and generally conducted through the crown portion of the hat into the interior of the hat heating the wearer's head.

To reduce the build up of heat, hats with ventilating holes or mesh have been developed. Unfortunately such efforts have had limited success in eliminating the problem of heat build up within the interior of such hats and caps, thus the absorption and conduction of radiant energy still presents a problem.

DE 4,123,632 comprises a head covering for shielding ultraviolet rays in the form of a hat, cap or other shape in different sizes, colors and materials. The head covering consists of a molded hat part in, which is inset the ultraviolet ray shield. The shield may be fixed or separate in the form of a forehead strip on the shoulder or as a shade. The shield may be loose or detachable. The head covering is designed to protect the wearer from ultraviolet rays from the atmosphere.

U.S. Pat. No. 3,766,565 shows an article of wearing apparel constructed of a material which is operable to reflect radiant energy away from a wearer and to prevent the rapid conduction of heat from an exterior surface to an interior surface thereof. A specific embodiment, comprising a hat having a crown portion constructed from the material is operable to reflect radiant energy away from the wearer's head and to prevent the rapid conduction of heat from an exterior surface to an interior surface of the crown portion. The hat is provided with a perforated crown portion to provide for the flow of air through the crown portion and may be provided with a visor portion constructed of the material of the crown portion. The material is also operable to reduce glare from remote objects when the crown portion is interposed between the object and a viewer with the exterior surface of the crown portion facing the object.

U.S. Pat. No. 5,630,230 teaches a cap element composing of a three-layer fabric including a mesh-like front surface fabric, a waterproof back surface fabric, and a non-woven fabric formed of water absorptive high molecular fibers sealed between the front surface fabric and the back surface fabric. At least one of the front surface fabric and the back surface fabric maybe subjected to ultraviolet ray shielding treatment or composed of a knitted or woven fabric formed of fibers of a high molecular polymer containing a inorganic material capable of absorbing ultraviolet rays and reflecting the heat rays of the sun.

U.S. Pat. No. 5,669,075 shows a lightweight cloth hat for warm weather use and for protection from the sun's ultraviolet rays including a main section capable of covering the top of a user's head and having a top with a side wall extending down from the top to ma peripheral edge. A visor section is connected to this edge at the front side. A flap section is connected to the peripheral edge at a rear side of the main section. During use of the hat, this flap section extends downwardly from the main section a substantial distance, which is sufficient to protect the wearer's neck and ears. At least the main section and the flap section comprise first and second outer layers of tightly woven, thin flexible cloth material and at least one thin inner layer of flexible cloth material. The inner layer is preferably made of a dense interfacing material that is at least 50% polyester. The layers are secured together by stitching. Both the visor section and the three layers of material in combination are sufficiently dense and opaque to prevent all ultraviolet sun rays from passing through the visor section and the layers to the wearer's head, neck and ears. Preferably the main section and the flap section have two thin, inner layers of interfacing material.

Additional examples of the prior art are found during in U.S. Pat. No. 2,357,851; U.S. Pat. No. 2,391,959; U.S. Pat. No. 2,803,827; U.S. Pat. No. 2,893,014; U.S. Pat. No. 2,908,012; U.S. Pat. No. 3,365,727; U.S. Pat. No. 5,018,220; U.S. Pat. No. 5,570,476; DE 3,540,939; DE 2,558,051; DE 2,558,051; JP 1-250,470; JP 62-122,751; JP 61-266,677; GB 1,294,076; GB 987,163; GB 764, 335; GB 570,567 and CA 457,813.

SUMMARY OF THE INVENTION

The present invention relates to a hat constructed of woven fabric capable of reflecting radiant energy from the exterior thereof and of releasing thermal energy from the interior thereof. Specifically, the hat comprises a single ply circular or oval side band having a double ply top panel and a double ply outer brim attached to the upper and lower peripheral edge portions thereof respectively.

The woven fabric comprises an open weave that virtually filters out the sun's heat. In particular, the open weave woven fabric comprises about 35 percent fiberglass and about 65 percent PVC on fiberglass or about 30 percent polyester and about 70 percent PVC on polyester. The open weave woven fabric has a thickness of from about 0.02 to about 0.04 inches and an openness factor of from about 10 percent to about 20 percent. The solar optical properties include a solar transmittance of from about 15 to about 25, a solar reflectance of from about 50 to about 60 and a solar absorptance of from about 20 to about 30. So composed, the open weave woven fabric has a ultra violet blockage of from about 80 percent to about 90 percent.

The open weave woven fabric hat of fiberglass and PVC on fiberglass or polyester and PVC on polyester has a relatively high degree of solar reflectance and relatively low solar transmittance with an openness factor sufficient to shield the head, neck and face of the wearer from the elements and to allow heat to escape from the interior thereof.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
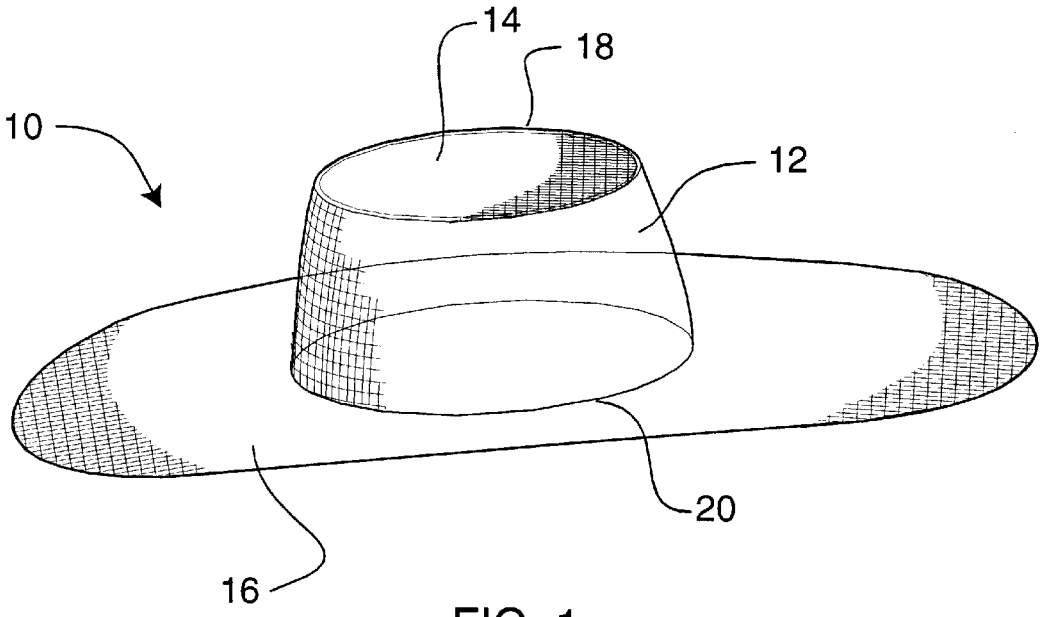
FIG. 1 is a perspective view of the hat of the present invention.
Figure 2:
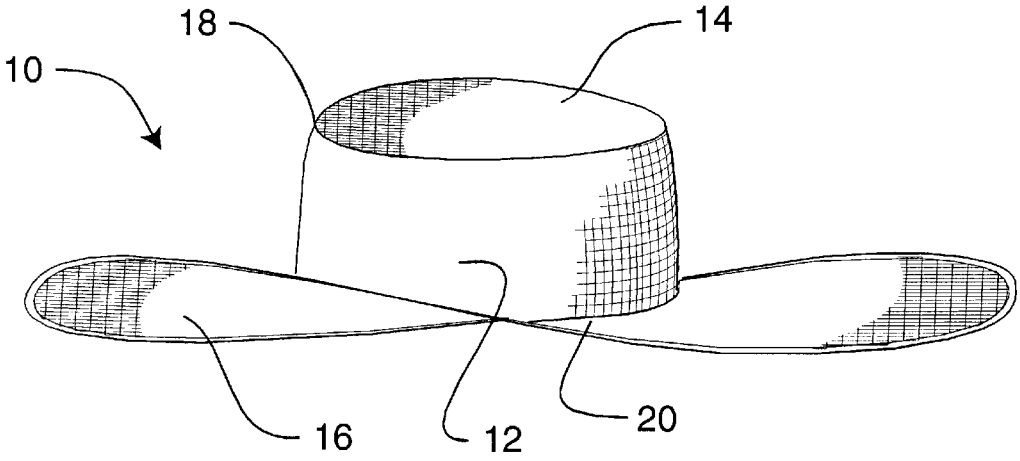
FIG. 2 is a side view of the hat of the present invention.
Figure 3:
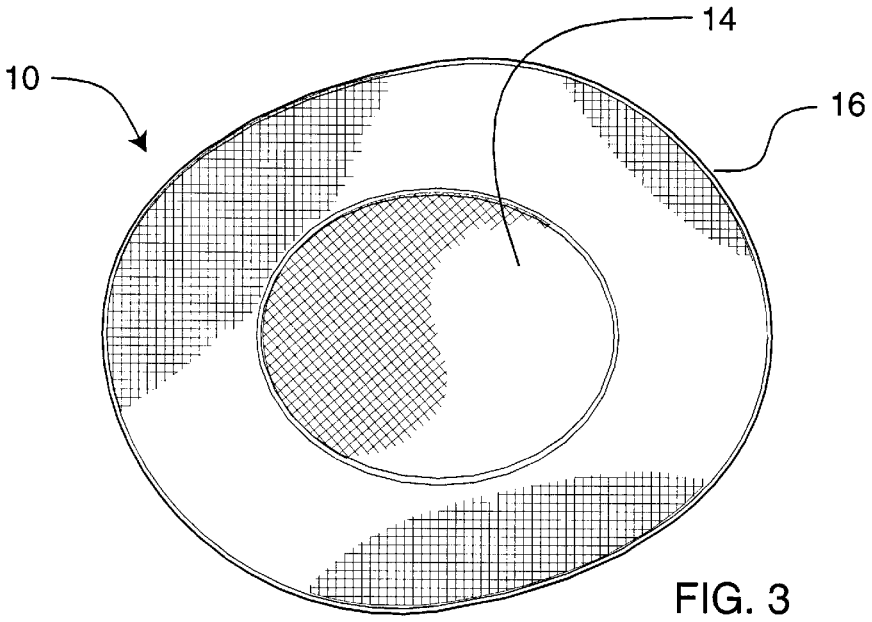
FIG. 3 is a top view of the hat of the present invention.

As shown in FIGS. 1 through 3, the present invention relates to a hat generally indicated as 10 including a side band, a top panel and an outer brim indicated as 12, 14 and 16 respectively. Specifically, the hat 10 comprises a single ply circular or oval side band 12 having a double ply top panel 14 and a double ply outer brim 16 attached to the upper peripheral edge portion 18 and the lower peripheral edge portion 20 respectively.

The side band 12, top panel 14 and outer brim 16 of the hat 10 are constructed or fabricated from an open weave woven fabric such as SheerWeave® Style 3000 produced by Phifer Wire Products, Inc. The fabric comprises a combination of fiberglass and PVC on fiberglass or polyester and PVC on polyester. In particular, the open weave woven fabric comprises from about 30 percent to about 40 percent fiberglass and from about 60 percent to about 70 percent PVC on fiberglass or from about 25 percent to about 35 percent polyester and from about 65 percent to about 75 percent PVC on polyester. Preferably, the open weave woven fabric comprises about 35 percent fiberglass and about 65 percent PVC on fiberglass or about 30 percent polyester and about 70 percent PVC on polyester.

The open weave woven fabric has a thickness of from about 0.02 inches to about 0.04 inches, a yarn diameter of from about 0.005 warp to about 0.015 warp and from about 0.02 fill to about 0.03 fill, and an openness factor of from about 10 percent to about 20 percent. The solar optical properties include a solar transmittance of from about 15 to about 25, a solar reflectance of from about 50 to about 60 and a solar absorptance of from about 20 to about 30. So composed, the open weave woven fabric has a ultra violet blockage of from about 80 percent to about 90 percent.

The open weave woven fabric has a thickness of preferably about 0.03 inches, a yarn diameter of preferably about 0.01 warp and about 0.025 fill and an openness factor of preferably about 14 percent. The preferable solar optical properties include a solar transmittance of about 20, a solar reflectance of about 55 and a solar absorptance of about 25.

Figure 4:
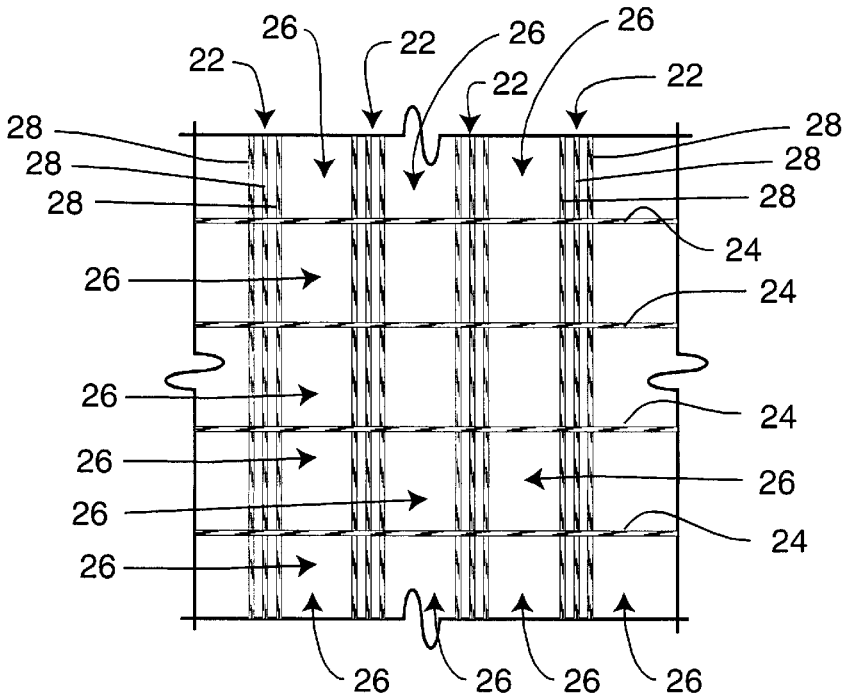
FIG. 4 is a detailed view of the open weave woven fabric of the present invention.

As shown in FIG. 4, the open weave woven fabric comprises a plurality of warp sections each generally indicated as 22 held in substantially parallel spaced relationship relative to each other by a plurality of substantially parallel spaced apart weft threads each indicated as 24 to cooperatively form a plurality of apertures each indicated as 26. Each warp section 22 comprises a plurality of warp threads each indicated as 28.

The open weave woven fabric hat 10 of fiberglass and PVC on fiberglass or polyester and PVC on polyester has a relatively high degree of solar reflectance and a relatively low solar transmittance with an openness factor sufficient to shield the head, neck and face of the wearer from the elements and to allow heat to escape from the interior thereof.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A hat constructed of woven fabric capable of reflecting radiant energy from the exterior thereof and of releasing thermal energy from the interior thereof, said hat comprising a side band having a top panel and an outer brim attached to the upper and lower peripheral portions thereof to shield the head, neck and face of the wearer from the elements and to allow heat to escape from the interior thereof, said side band, top panel and outer brim of said hat are constructed from an open weave woven fabric comprising a combination of fiberglass and PVC on fiberglass.

2. The hat of claim 1 wherein said open weave woven fabric has an ultra violet blockage from about 80 percent to about 90 percent.

3. The hat of claim 2 wherein said open weave woven fabric has an openness factor of from about 10 percent to about 20 percent.

4. The hat of claim 3 wherein said open weave woven fabric comprises from about 30 percent to about 40 percent fiberglass and from about 60 percent to about 70 percent PVC on fiberglass.

5. The hat of claim 4 wherein said open weave woven fabric has a thickness of from about 0.02 inches to about 0.04 inches, a yarn diameter of from about 0.005 warp to about 0.015 warp and from about 0.02 fill to about 0.03 fill.

6. The hat of claim 5 wherein the solar optical properties of said open weave woven fabric includes a solar transmittance of from about 15 to about 25, a solar reflectance of from about 50 to about 60 and a solar absorptance of from about 20 to about 30.

7. The hat of claim 1 wherein said open weave woven fabric comprises a plurality of warp sections held in substantially parallel spaced relationship relative to each other by a plurality of substantially parallel spaced apart weft threads to cooperatively form a plurality of apertures.

8. The hat of claim 7 wherein each said warp section comprises a plurality of warp threads.

9. The hat of claim 1 wherein the open weave woven fabric has a ultra violet blockage of about 86 percent.

10. The hat of claim 9 wherein said open weave woven fabric preferably has an openness factor of about 14 percent.

11. The hat of claim 10 wherein said open weave woven fabric comprises about 35 percent fiberglass and about 65 percent PVC on fiberglass.

12. The hat of claim 11 wherein said open weave woven fabric has a thickness of about 0.03 inches, a yarn diameter of about 0.01 warp and about 0.025 fill.

13. The hat of claim 12 wherein said solar optical properties of said open weave woven fabric includes a solar transmittance of about 20, a solar reflectance of about 55 and a solar absorptance of about 25.

14. A hat constructed of woven fabric capable of reflecting radiant energy from the exterior thereof and of releasing thermal energy from the interior thereof, said hat comprising a single ply side band having a double ply top panel and a double ply outer brim attached to the upper and lower peripheral portions thereof to shield the head, neck and face of the wearer from the elements and to allow heat to escape from the interior thereof.

15. The hat of claim 14 wherein said side band, top panel and outer brim of said hat a re constructed from an open weave woven fabric comprising a combination of fiberglass and PVC on fiberglass.

16. The hat of claim 15 wherein said open weave woven fabric has an ultra violet blockage from about 80 percent to about 90 percent.

17. The hat of claim 16 wherein said open weave woven fabric has an openness factor of from about 10 percent to about 20 percent.

18. The hat of claim 17 wherein said open weave woven fabric comprises from about 30 percent to about 40 percent fiberglass and from about 60 percent to about 70 percent PVC on fiberglass.

19. The hat of claim 18 wherein said open weave woven fabric has a thickness of from about 0.02 inches to about 0.04 inches, a yarn diameter of from about 0.005 warp to about 0.015 warp and from about 0.02 fill to about 0.03 fill.

20. The hat of claim 19 wherein the solar optical properties of said open weave woven fabric includes a solar transmittance of from about 15 to about 25, a solar reflectance of from about 50 to about 60 and a solar absorptance of from about 20 to about 30.

21. The hat of claim 15 wherein said open weave woven fabric comprises a plurality of warp sections held in substantially parallel spaced relationship relative to each other by a plurality of substantially parallel spaced apart weft threads to cooperatively form a plurality of apertures.

22. The hat of claim 21 wherein each said warp section comprises a plurality of warp threads.

23. The hat of claim 15 wherein said open weave woven fabric has a ultra violet blockage of about 86 percent.

24. The hat of claim 23 wherein said open weave woven fabric has an openness factor of about 14 percent.

25. The hat of claim 24 wherein said open weave woven fabric comprises about 35 percent fiberglass and about 65 percent PVC on fiberglass.

26. The hat of claim 25 wherein said open weave woven fabric has a thickness of about 0.03 inches, a yarn diameter of about 0.01 warp and about 0.025 fill.

27. The hat of claim 26 wherein said solar optical properties of said open weave woven fabric includes a solar transmittance of about 20, a solar reflectance of about 55 and a solar absorptance of about 25.

28. The hat of claim 14 wherein said side band, top panel and outer brim of said hat are constructed from an open weave woven fabric comprising a combination of polyester and PVC on polyester.

29. The hat of claim 28 wherein said open weave woven fabric has an ultra violet blockage from about 80 percent to about 90 percent.

30. The hat of claim 29 wherein said open weave woven fabric has an openness factor of from about 10 percent to about 20 percent.

31. The hat of claim 30 wherein said open weave woven fabric comprises from about 30 percent to about 40 percent polyester and from about 60 percent to about 70 percent PVC on polyester.

32. The hat of claim 31 wherein said open weave woven fabric has a thickness of from about 0.02 inches to about 0.04 inches, a yarn diameter of from about 0.005 warp to about 0.015 warp and from about 0.02 fill to about 0.03 fill.

33. The hat of claim 32 wherein the solar optical properties of said open weave woven fabric includes a solar transmittance of from about 15 to about 25, a solar reflectance of from about 50 to about 60 and a solar absorptance of from about 20 to about 30.

34. The hat of claim 28 wherein said open weave woven fabric comprises a plurality of warp sections held in substantially parallel spaced relationship relative to each other by a plurality of substantially parallel spaced apart weft threads to cooperatively form a plurality of apertures.

35. The hat of claim 34 wherein each said warp section comprises a plurality of warp threads.

36. The hat of claim 28 wherein the open weave woven fabric has a ultra violet blockage of about 86 percent.

37. The hat of claim 36 wherein said open weave woven fabric has an openness factor of about 14 percent.

38. The hat of claim 37 wherein said open weave woven fabric comprises about 35 percent polyester and about 65 percent PVC on polyester.

39. The hat of claim 38 wherein said open weave woven fabric has a thickness of about 0.03 inches, a yarn diameter of about 0.01 warp and about 0.025 fill.

40. The hat of claim 39 wherein said solar optical properties of said open weave woven fabric includes a solar transmittance of about 20, a solar reflectance of about 55 and a solar absorptance of about 25.

* * * * *